US010246314B2

(12) United States Patent
Itasaka et al.

(10) Patent No.: US 10,246,314 B2
(45) Date of Patent: Apr. 2, 2019

(54) WIRE LOCKING STRUCTURE FOR BOOM EXTENSION

(71) Applicant: TADANO LTD., Kagawa (JP)

(72) Inventors: Yoshikado Itasaka, Kagawa (JP); Yudai Masuda, Kagawa (JP)

(73) Assignee: TADANO LTD., Kagawa (JP)

( * ) Notice: Subject to any disclaimer, the term of this patent is extended or adjusted under 35 U.S.C. 154(b) by 103 days.

(21) Appl. No.: 15/553,677

(22) PCT Filed: Oct. 30, 2015

(86) PCT No.: PCT/JP2015/080798

§ 371 (c)(1),
(2) Date: Aug. 25, 2017

(87) PCT Pub. No.: WO2016/136032

PCT Pub. Date: Sep. 1, 2016

(65) Prior Publication Data

US 2018/0029857 A1 Feb. 1, 2018

(30) Foreign Application Priority Data

Feb. 27, 2015 (JP) ..... 2015-039156

(51) Int. Cl.
*B66C 23/70* (2006.01)
*B66F 9/065* (2006.01)
(Continued)

(52) U.S. Cl.
CPC ..... *B66F 9/0655* (2013.01); *B66C 23/703* (2013.01); *B66C 23/705* (2013.01);
(Continued)

(58) Field of Classification Search
CPC ... B66C 23/703; B66C 23/705; B66F 9/0655; E02F 3/388
See application file for complete search history.

(56) References Cited

U.S. PATENT DOCUMENTS 2,668,625 A * 2/1954 Garland ..... B66C 23/36 212/231
3,227,295 A * 1/1966 Hamilton ..... A01G 23/006 144/4.1
(Continued)

FOREIGN PATENT DOCUMENTS

EP 1052213 A2 * 11/2000 ..... B66C 23/703
FR 2553396 A * 4/1985
(Continued)

*Primary Examiner* — Emmanuel M Marcelo
(74) *Attorney, Agent, or Firm* — Paratus Law Group, PLLC

(57) ABSTRACT

A boom-extending wire locking structure has a wire locking tool, provided at a base end side of a first boom member and/or a base end side of a third boom member, that locks an extending wire by winding a lock part of each wire member. The wire locking tool includes: a pair of fixing pieces provided on both sides in an orthogonal direction orthogonal to a boom-extending direction and fixed to the first boom member and/or the third boom member; and wire locking parts, provided between the pair of fixing pieces, including arch-shaped grooves for winding the respective lock parts of the wire members. The wire locking parts are arranged in a central axis direction of the arc shape between the pair of fixing pieces. Central axes of the wire locking parts are arranged at different positions in the orthogonal direction from respective adjacent wire locking parts.

2 Claims, 5 Drawing Sheets

(51) Int. Cl.
*B66F 9/06* (2006.01)
*E02F 3/38* (2006.01)

(52) U.S. Cl.
CPC ..... *B66F 9/06* (2013.01); *B66F 9/065* (2013.01); *E02F 3/388* (2013.01)

(56) References Cited

U.S. PATENT DOCUMENTS

| | | | | | |
|---|---|---|---|---|---|
| 4,102,463 | A * | 7/1978 | Schmidt | E04G 19/003 | 187/226 |
| 5,695,082 | A * | 12/1997 | Rainwater | B66C 23/705 | 212/177 |
| 5,758,785 | A * | 6/1998 | Spinosa | B66C 23/48 | 212/232 |
| 5,983,825 | A * | 11/1999 | Nowak | G09F 17/00 | 116/173 |
| 8,381,460 | B1 * | 2/2013 | McDermott | E01D 21/00 | 52/117 |
| 2007/0058968 | A1 * | 3/2007 | Chapman | B60R 11/04 | 396/428 |
| 2016/0131279 | A1 * | 5/2016 | Kemp | F16L 3/015 | 248/55 |

FOREIGN PATENT DOCUMENTS

| | | | |
|---|---|---|---|
| JP | 07-157285 | A | 6/1995 |
| JP | 2801649 | B2 * | 9/1998 |
| JP | 2001130871 | A * | 5/2001 |
| JP | 2002-128470 | A | 5/2002 |

* cited by examiner

WIRE LOCKING STRUCTURE FOR BOOM EXTENSION

CROSS REFERENCE TO PRIOR APPLICATION

This application is a National Stage Patent Application of PCT International Patent Application No. PCT/JP2015/080798 (filed on Oct. 30, 2015) under 35 U.S.C. § 371, which claims priority to Japanese Patent Application No. 2015-039156 (filed on Feb. 27, 2015), which are all hereby incorporated by reference in their entirety.

TECHNICAL FIELD

The present invention relates to a boom-extending wire locking structure of an extendable boom that is provided in a mobile crane, and provided with an extending mechanism of the wire-rope type, for example.

BACKGROUND ART

A conventional extending mechanism of the wire-rope type (see, for example, PTL 1) includes a first boom member, a second boom member that is movable with respect to the first boom member in the extension/contraction direction, a third boom member that is movable with respect to the second boom member in the extension/contraction direction, a driving part that provides a driving force for moving the second boom member with respect to the first boom member in the extending direction, an extending sheave provided at the leading end side of the second boom member, and an extending wire that is wound around the extending sheave and couples the base end side of the first boom member and the base end side of the third boom member. In this conventional extending mechanism of the wire-rope type, the third boom member is moved with respect to the second boom member in the extending direction by moving a coupling part of the extending wire wound around the extending sheave on the third boom member side in the extending direction of the boom by the operation of the second boom member that moves with respect to the first boom member in the extending direction with the driving part.

In the extending mechanism of the wire-rope type, the base end side of the first boom member and the base end side of the third boom member are coupled with each other with a plurality of extending wires. In the case where the first boom member and the third boom member are coupled with each other with a plurality of extending wires, wire terminal metal fittings are attached to both end portions of the extending wires, and the wire terminal metal fittings are coupled with the first boom member and the third boom member through the coupling metal fitting. In the case where the first boom member and the third boom member are coupled with each other with a plurality of extending wires, two wire terminal metal fittings are required for each extending wire, and consequently the manufacturing cost of the extending wire is increased.

In view of this, an extending mechanism of the wire-rope type which can reduce the manufacturing cost of an extending wire is conceivable (see, for example, PTL 2). In this extending mechanism of the wire-rope type, a plurality of extending wires are composed of one wire member, an equalizer sheave is provided to one or both of the base end side of the first boom member and the base end side of the third boom member, and the extending wire is wound around the equalizer sheave, whereby the extending wire is coupled with the first boom member and the third boom member.

CITATION LIST

Patent Literature

PTL 1
Japanese Patent Application Laid-Open No. 2002-128470
PTL 2
Japanese Patent Application Laid-Open No. 07-157285

SUMMARY OF INVENTION

Technical Problem

However, in the boom extending mechanism in which the first boom member and the third boom member are coupled with the extending wire through the equalizer sheave, the number of the wire terminal metal fittings of the extending wire can be reduced, but, when a plurality of equalizer sheaves are provided for one boom member, the installation space of the equalizer sheaves is difficult to provide due to the large external shape of the equalizer sheave.

An object of the present invention is to provide a boom-extending wire locking structure which can reduce the number of the wire terminal metal fittings, and can save the space for the coupling part of the boom member.

Solution to Problem

To achieve the above-mentioned object, in a boom-extending wire locking structure of an extendable boom of the embodiment of the present invention, the extendable boom includes: a first boom member; a second boom member that is movable with respect to the first boom member in an extension/contraction direction; a third boom member that is movable with respect to the second boom member in the extension/contraction direction; a driving part that provides a driving force for moving the second boom member with respect to the first boom member in the extending direction; an extending sheave provided at a leading end side of the second boom member; and an extending wire that is wound around the extending sheave, and couples a base end side of the first boom member and a base end side of the third boom member. The extendable boom moves the third boom member with respect to the second boom member in the extending direction by moving a coupling part of the extending wire wound around the extending sheave on the third boom member side in the extending direction of the boom by an operation of the second boom member that moves with respect to the first boom member in the extending direction by the driving part. The extending wire includes multiple pairs of stretched parts stretched between the base end side of the first boom member and the base end side of the third boom member, and a locking part that is locked at least one of the base end side of the first boom member and the base end side of the third boom, a wire locking tool is provided between the pairs of the stretched parts at at least one of the base end side of the first boom member and the base end side of the third boom member, the wire locking tool being configured to lock the extending wire by winding the locking part formed by one wire member together with the pair of stretched parts, the wire locking tool includes a pair of fixing pieces provided on both sides in a direction orthogonal to the extending direction of the extendable boom and fixed to at least one of the first boom member and the third boom member, and a plurality of wire locking parts, each of which is provided between the pair of fixing pieces, wherein the locking part of the extending wire is wound around a groove formed along an outer periphery part of an arc shape of each wire locking part, and the plurality of wire locking parts are arranged in a central axis direction of the arc shape between the pair of fixing pieces, and positions of central axes of the wire locking parts adjacent to each other are different from each other in a direction orthogonal to the extending direction of the extendable boom.

With this configuration, the distance between a groove of the outer periphery part of the wire locking part, and another groove of the outer periphery part of the wire locking part can be increased in comparison with the case where the central axes overlap in a direction orthogonal to the extension/contraction direction of the boom, and accordingly the thickness of the member of the wire locking tool can be increased at a portion between a groove of the outer periphery part of the wire locking part, and another groove of the outer periphery part of the wire locking part in a direction orthogonal to the extension/contraction direction of the boom.

Advantageous Effects of Invention

According to the present invention, since the thickness of the member of the wire locking tool can be increased at a portion between a groove of the outer periphery part of the wire locking part, and another groove of the outer periphery part of the wire locking part in a direction orthogonal to the extension/contraction direction of the boom, a plurality of wire locking parts can be formed without increasing the thickness of the wire locking tool, and the installation space can be saved in the case where the wire locking tool is installed in the boom member.

DESCRIPTION OF EMBODIMENTS

FIG. 1 to FIG. 6 illustrate an embodiment of the present invention.

Extendable boom 10 including a boom-extending wire locking structure of the embodiment of the present invention is applied to a mobile crane, and is coupled with a slewing base of the mobile crane such that extendable boom 10 can be raised and lowered. In the following description of the present embodiment, the extension/contraction direction of the extendable boom is the horizontal direction, and the direction perpendicular to the horizontal direction is the vertical direction.

Figure 1A:
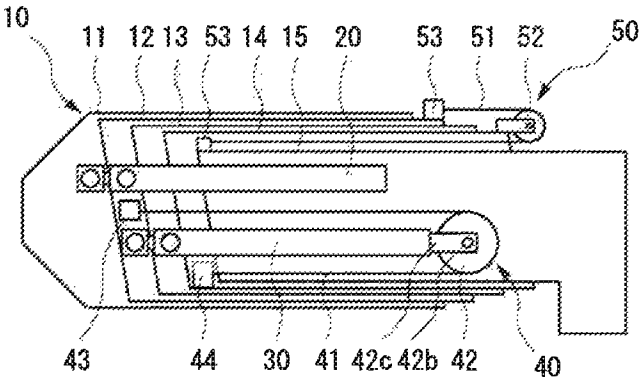
FIGS. 1A and 1B are schematic views illustrating a configuration of an extendable boom of an embodiment of the present invention, and the extendable boom in a shortest state and the extendable boom in a longest state are illustrated in FIG. 1A and FIG. 1B, respectively.
Figure 1B:
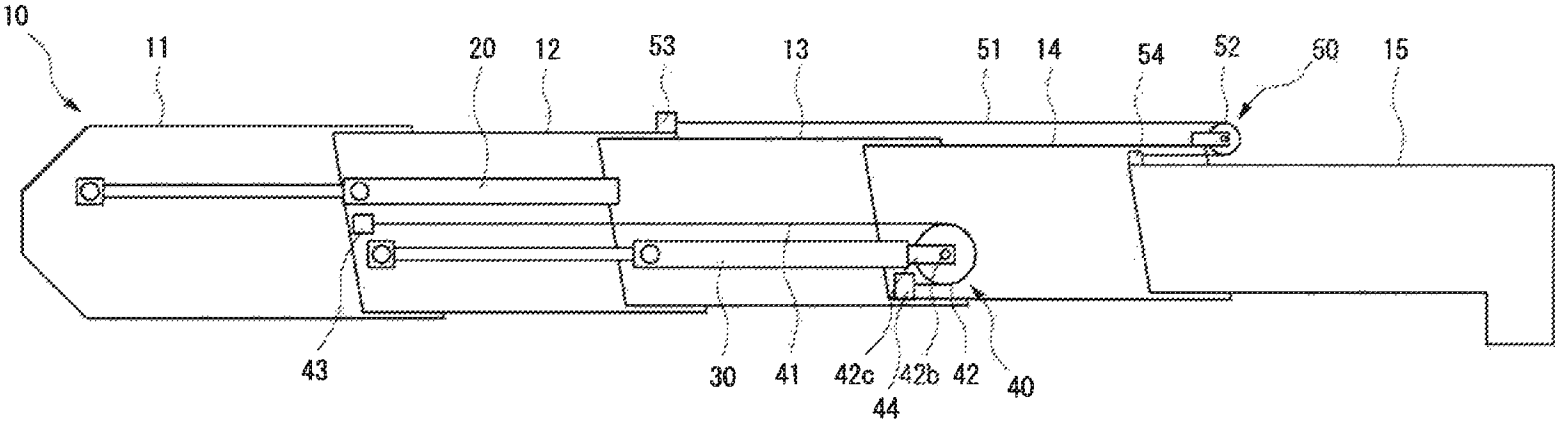

As illustrated in FIG. 1, extendable boom 10 includes a plurality of boom members 11, 12, 13, 14, and 15 (hereinafter referred to as boom members 11 to 15), each of which is formed in a cylindrical shape having a polygonal cross-sectional shape, and boom members 11, 12, 13, and 14 can house adjacent boom members 12, 13, 14, and 15 on the leading end side, respectively. Extendable boom 10 of the present embodiment is of a five-stage type, and is composed of, from the base end side, base boom 11, second boom 12 as the first boom member, third boom 13 as the second boom member, fourth boom 14 as the third boom member, and top boom 15. Extendable boom 10 performs an extension/contraction operation by moving second boom 12, third boom 13, fourth boom 14, and top boom 15 with respect to base boom 11, second boom 12, third boom 13, and fourth boom 14, respectively.

As illustrated in FIG. 1, extendable boom 10 includes first extendable cylinder 20, second extendable cylinder 30, fourth boom extending mechanism 40, and top boom extending mechanism 50. First extendable cylinder 20 is configured for moving second boom 12 with respect to base boom 11 in the extension/contraction direction. Second extendable cylinder 30 serves as a driving part for moving third boom 13 with respect to second boom 12 in the extension/contraction direction. Fourth boom extending mechanism 40 is configured for moving fourth boom 14 in the extending direction with respect to third boom 13 in conjunction with the extending operation of third boom 13 with respect to second boom 12. Top boom extending mechanism 50 is configured for moving top boom 15 with respect to fourth boom 14 in the extending direction in conjunction with an extending operation of third boom 13 with respect to second boom 12 and an extending operation of fourth boom 14 with respect to third boom 13.

In addition, although not illustrated in the drawings, extendable boom 10 includes a boom contraction mechanism for performing the contraction operation of top boom 15 with respect to fourth boom 14, and the contraction operation of fourth boom 14 with respect to third boom 13 in conjunction with the contraction operation of second boom 12 and third boom 13.

First extendable cylinder 20 is a hydraulic cylinder that includes a cylinder tube and a piston rod, and operates with operation oil supplied from a hydraulic pump not illustrated. First extendable cylinder 20 is disposed on the upper side and at a center portion in the width direction inside boom members 11 to 15. In first extendable cylinder 20, an end portion of the piston rod is coupled with a base end portion of base boom 11, and the cylinder tube is coupled with a base end portion of second boom 12.

Second extendable cylinder 30 is a hydraulic cylinder that includes a cylinder tube and a piston rod and operates with operation oil supplied from a hydraulic pump not illustrated. Second extendable cylinder 30 is disposed below first extendable cylinder 20 and at a center portion in the width direction. In second extendable cylinder 30, an end portion of the piston rod is coupled with a base end portion of second boom 12, and the cylinder tube is coupled with an end portion of the third boom base.

Fourth boom extending mechanism 40 includes fourth boom extending wire 41, fourth boom extending sheave 42, first coupling metal fitting 43, and second coupling metal fitting 44. Fourth boom extending wire 41 couples the base end side of second boom 12 and the base end side of fourth boom 14. Fourth boom extending sheave 42 is provided on the leading end side of third boom 13, and fourth boom extending wire 41 is wound around fourth boom extending sheave 42. First coupling metal fitting 43 couples second boom 12 and fourth boom extending wire 41. Second coupling metal fitting 44 serves as a wire locking tool for coupling fourth boom 14 and fourth boom extending wire 41.

Figure 2:
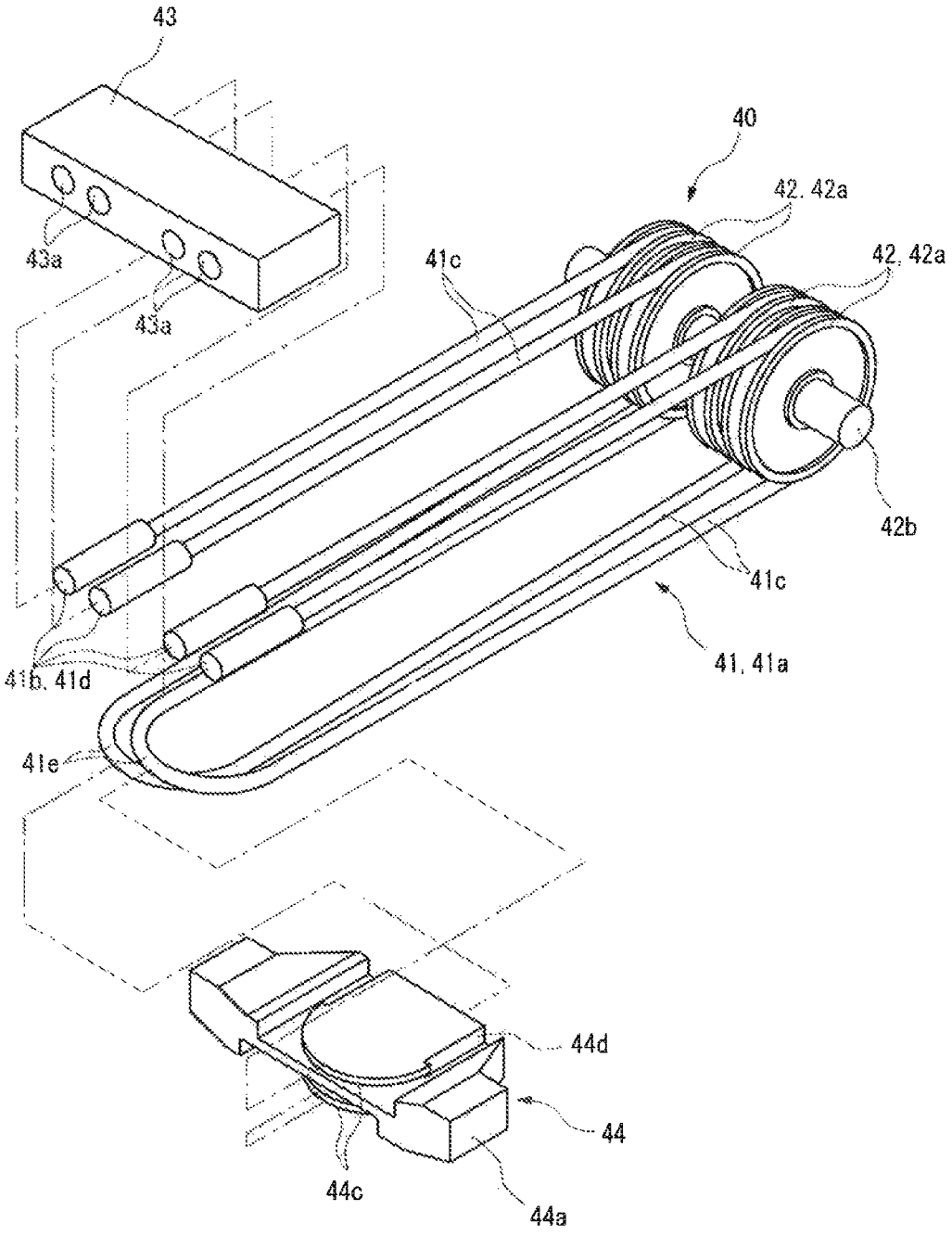
FIG. 2 is a perspective view illustrating a configuration of a fourth boom extending mechanism.

As illustrated in FIG. 2, fourth boom extending wire 41 is composed of two wire members 41*a* formed by twisting a piano wire and/or a hard steel wire together in a rope shape. Terminal metal fittings 41*b* are attached at both end portions of wire member 41*a*. The both end portions of wire member 41*a* are fixed to first coupling metal fitting 43, and the middle portion of wire member 41*a* is locked by second coupling metal fitting 44. That is, in the state where fourth boom extending wire 41 is attached between second boom 12 and fourth boom 14, fourth boom extending wire 41 includes two pairs of stretched parts 41*c* stretched between second boom 12 and fourth boom 14, two pairs of fixing parts 41*d* fixed to first coupling metal fitting 43, and two locking parts 41*e* locked by second coupling metal fitting 44.

Figure 6:
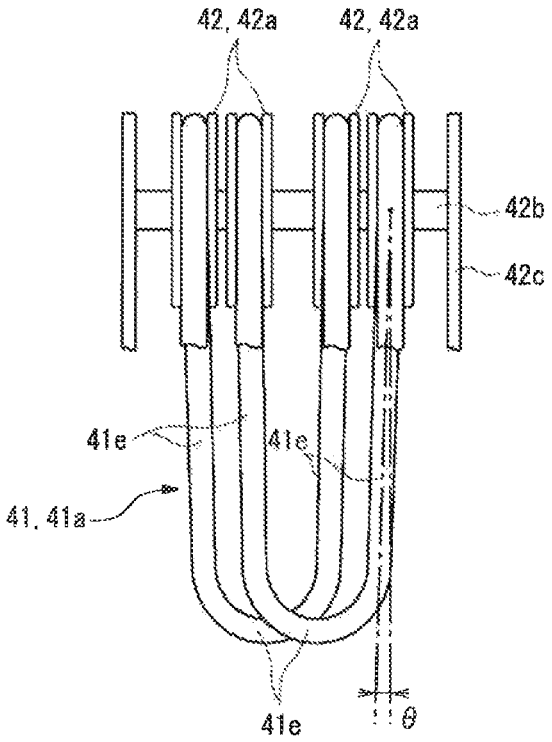
FIG. 6 illustrates a relationship between a fourth boom extending wire and a fourth boom extending sheave.

As illustrated in FIG. 2, fourth boom extending sheave 42 is composed of four extending sheaves 42*a* around which stretched parts 41*c* of fourth boom extending wire 41 are wound. Four extending sheaves 42*a* are arranged side by side around support shaft 42*b* extending in the width direction of extendable boom 10, and are supported to be rotatable with respect to support shaft 42*b*. As illustrated in FIG. 1, support shaft 42*b* is supported by bracket 42*c* extending in the extending direction of extendable boom 10 from an end portion of a cylinder tube of second extendable cylinder 30 located at the leading end side of third boom 13. As illustrated in FIG. 6, bracket 42*c* is disposed in a pair in the width direction and supports both end portions of support shaft 42*b*.

First coupling metal fitting 43 is a metal member that is formed by casting, for example, and is disposed between second extendable cylinder 30 and first extendable cylinder 20 on the base end side in second boom 12 as illustrated in FIG. 1. As illustrated in FIG. 2, first coupling metal fitting 43 is provided with four fixation holes 43*a* for fixation and insertion of fixing parts 41*d* of fourth boom extending wire 41. Four fixation holes 43*a* are extended in the front-rear direction of extendable boom 10 and are provided at intervals in the width direction.

Figure 3:
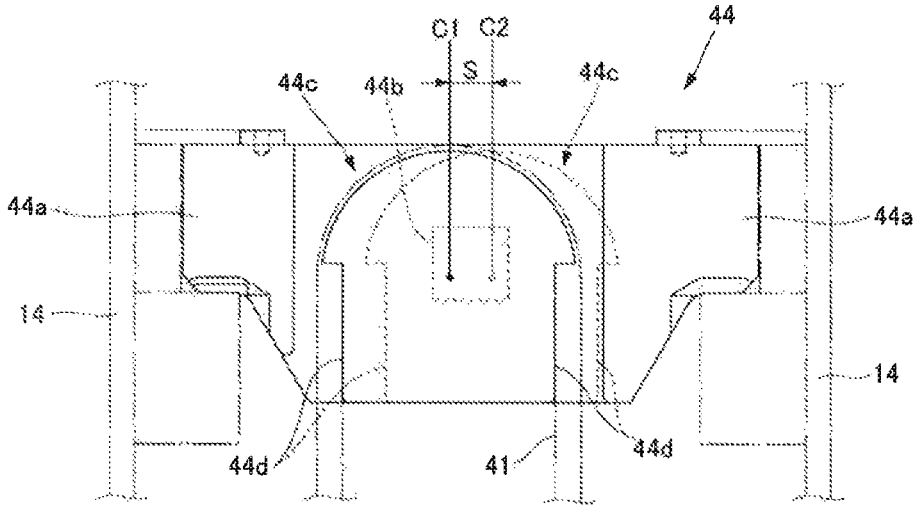
FIG. 3 is a plan view of a second coupling metal fitting.
Figure 4:
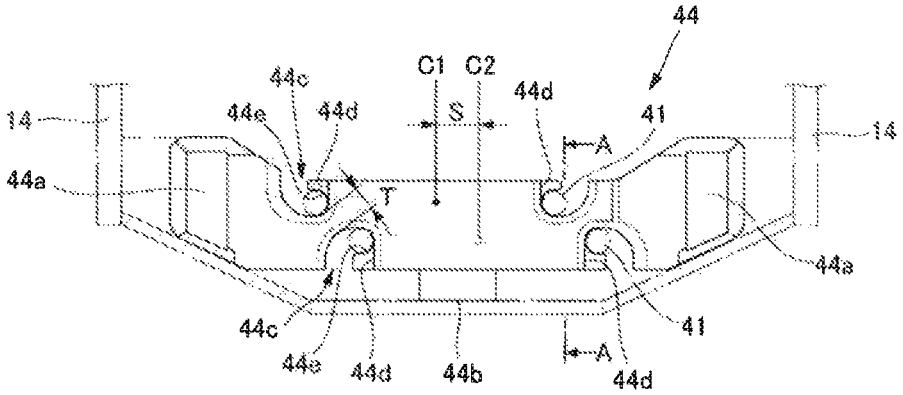
FIG. 4 illustrates the second coupling metal fitting as viewed from the leading end side of the extendable boom.

For example, second coupling metal fitting 44 is a metal member formed by casting, and is disposed on the lower surface on the base end side in fourth boom 14 as illustrated in FIG. 1. As illustrated in FIG. 3 and FIG. 4, on the both sides in the width direction of second coupling metal fitting 44, fixing piece 44*a* for fixing second coupling metal fitting 44 to fourth boom 14 is provided to extend outward in the width direction along the lower surface in fourth boom 14. In addition, as illustrated in FIG. 3 and FIG. 4, at the bottom surface of second coupling metal fitting 44, contact part 44*b* that makes contact with the lower surface in fourth boom 14 is provided to protrude downward. Second coupling metal fitting 44 is vertically positioned with respect to fourth boom 14 by contact part 44*b*, and positioned in the front-rear direction with respect to fourth boom 14 by fixing piece 44*a* inside fourth boom 14.

Figure 5:
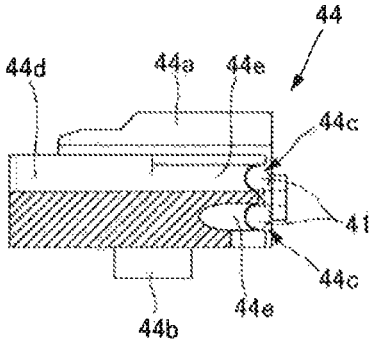
FIG. 5 is a sectional view taken along line A-A of FIG. 4.

In addition, as illustrated in FIG. 4 and FIG. 5, on the upper and lower surfaces of second coupling metal fitting 44, wire locking part 44*c* for winding locking part 41*e* of fourth boom extending wire 41, and guiding part 44*d* for guiding, in the extension/contraction direction of extendable boom 10, the end portion on wire locking part 44*c* side of stretched part 41*c* of fourth boom extending wire 41 wound around wire locking part 44*c* are provided.

Groove 44*e* extending along a nearly semicircular arc portion having a predetermined diameter is formed in wire locking part 44*c*, and locking part 41*e* of fourth boom extending wire 41 is wound around groove 44*e*. Groove 44*e* has an arc shape having a diameter and a groove bottom diameter identical to the radial size and the groove bottom diameter of a pulley for winding a wire having a diameter identical to that of fourth boom extending wire 41.

Guiding part 44*d* is a surface that is flush with the groove bottom and extends in the extension/contraction direction of extendable boom 10 from the both end portions of groove 44*e* of wire locking part 44*c*. The end portion on wire locking part 44*c* side of stretched part 41*c* of fourth boom extending wire 41 is brought into contact with guiding part 44*d*, and thus guided in the extension/contraction direction of extendable boom 10.

Wire locking part 44*c* and guiding part 44*d* on the upper side, and wire locking part 44*c* and guiding part 44*d* on the lower side of second coupling metal fitting 44 are disposed such that radial central axes C1 and C2 of the arc portions of respective wire locking parts 44*c* are located at different positions separated by a predetermined space S in the width direction of extendable boom 10. In addition, in second coupling metal fitting 44, the positions of wire locking part 44*c* and guiding part 44*d* on the upper side, and wire locking part 44*c* and guiding part 44*d* on the lower side are identical to each other in the extension/contraction direction of extendable boom 10.

That is, in second coupling metal fitting 44, the components are shifted in the width direction of extendable boom 10 such that the both end portions of groove 44*e* of wire locking part 44*c* and guiding part 44*d* on the upper side, and the both end portions of groove 44*e* of wire locking part 44*c* and guiding part 44*d* on the lower side do not overlap in the vertical direction. With this configuration, as illustrated in FIG. 4, thickness T of the components of second coupling metal fitting 44 can be increased at a portion between the both end portions of groove 44*e* of wire locking part 44*c* and guiding part 44*d* on the upper side, and the both end portions of groove 44*e* of wire locking part 44*c* and guiding part 44*d* on the lower side.

In addition, stretched part 41*c* of fourth boom extending wire 41 wound around wire locking part 44*c* on the upper side is disposed at such a position where it does not overlap stretched part 41*c* of fourth boom extending wire 41 wound around wire locking part 44*c* on the lower side, in the vertical direction.

Here, extending sheaves 42*a* of fourth boom extending sheave 42 are disposed at positions substantially opposite to the end portions of grooves 44*e* of wire locking part 44*c* in the extension/contraction direction of extendable boom 10. That is, extending sheaves 42*a* are disposed such that the so-called fleet angle is a predetermined angle (for example, 2 degrees) or smaller in the relationship with stretched parts 41*c* of fourth boom extending wire 41 wound around wire locking parts 44*c* of second coupling metal fitting 44. In the present embodiment, the fleet angle is angle κ that is an angle between the extension/contraction direction of extendable boom 10 and the extending direction of stretched part 41*c* of fourth boom extending wire 41 as illustrated in FIG. 6.

Top boom extending mechanism 50 includes top boom extending wire 51, top boom extending sheave 52, third coupling metal fitting 53, and fourth coupling metal fitting 54. Top boom extending wire 51 couples the leading end side of second boom 12 and the base end side of top boom 15. Top boom extending sheave 52 is provided on the leading end side of fourth boom 14, and top boom extending wire 51 is wound around top boom extending sheave 52. Third coupling metal fitting 53 couples second boom 12 and top boom extending wire 51. Fourth coupling metal fitting 54 couples top boom 15 and top boom extending wire 51.

As described above, in the boom-extending wire locking structure of the extendable boom of the present embodiment, second coupling metal fitting 44 includes a pair of fixing pieces 44*a* provided on the both sides in the width direction of extendable boom 10 and fixed to fourth boom 14, and wire locking part 44*c* provided between the pair of fixing pieces 44*a* in which locking part 41*e* of fourth boom extending wire 41 is wound around groove 44*e* formed along an outer periphery part of an arc shape. Wire locking parts 44*c* on the upper and lower sides of second coupling metal fitting 44 are arranged in the central axis direction of the arc shape between the pair of fixing pieces 44*a,* and central axis C1 of upper wire locking part 44*c* is separated from central axis C2 of lower wire locking part 44*c* by predetermined space S in the width direction of extendable boom 10.

With this configuration, thickness T of the components of second coupling metal fitting 44 can be increased at a portion between the both end portions of groove 44*e* of wire locking part 44*c* and guiding part 44*d* on the upper side, and the both end portions of groove 44*e* of wire locking part 44*c* and guiding part 44*d* on the lower side. Accordingly, two wire locking parts 44*c* can be formed without increasing the thickness of second coupling metal fitting 44 in the vertical direction, and the installation space in installation of second coupling metal fitting 44 in fourth boom 14 can be saved.

In addition, in the extension/contraction direction of extendable boom 10, extending sheaves 42*a* are disposed at positions opposite to respective end portions of groove 44*e* of wire locking part 44*c* in the width direction.

With this configuration, in the relationship with stretched part 41*c* of fourth boom extending wire 41 wound around wire locking part 44*c,* the fleet angle can be set to a predetermined angle or smaller, and rubbing of fourth boom extending wire 41 against extending sheave 42*a* can be prevented.

While an extendable boom having a boom-extending wire locking structure in the embodiment is applied to an extendable boom of a mobile crane, the present invention is not limited to this. As long as an extendable boom of a wire rope type is provided, the boom may also be applied to a high-lift working vehicle including an extendable boom for vertically moving a working bucket, for example.

In addition, while the present invention is applied to extendable boom 10 of a five-stage type in the embodiment, the present invention may also be applied to any extendable booms of a multistage type other than extendable booms of the five-stage type as long as the extendable boom includes an extending mechanism of a wire-type boom.

In addition, while the present invention is applied to fourth boom extending mechanism 40 for extending fourth boom 14 of extendable boom 10 of the five-stage type in the embodiment, the present invention is not limited to the configuration of extending fourth boom 14.

In addition, while the driving part is hydraulic second extendable cylinder 30 in the embodiment, electric actuators such as an electric motor may be used as long as third boom 13 can be moved with respect to second boom 12, for example.

In addition, while second coupling metal fitting 44 in which two wire locking parts are formed in the vertical direction is described in the embodiment, the present invention is not limited to this. Three or more wire locking parts may also be disposed in the vertical direction as long as the both end portions of adjacent wire locking parts do not overlap in the vertical direction.

In addition, while the wire locking part has a sheave shape around which a wire rope is wound in the embodiment, the present invention is not limited to this as long as a wire rope can be wound.

Figure 7:
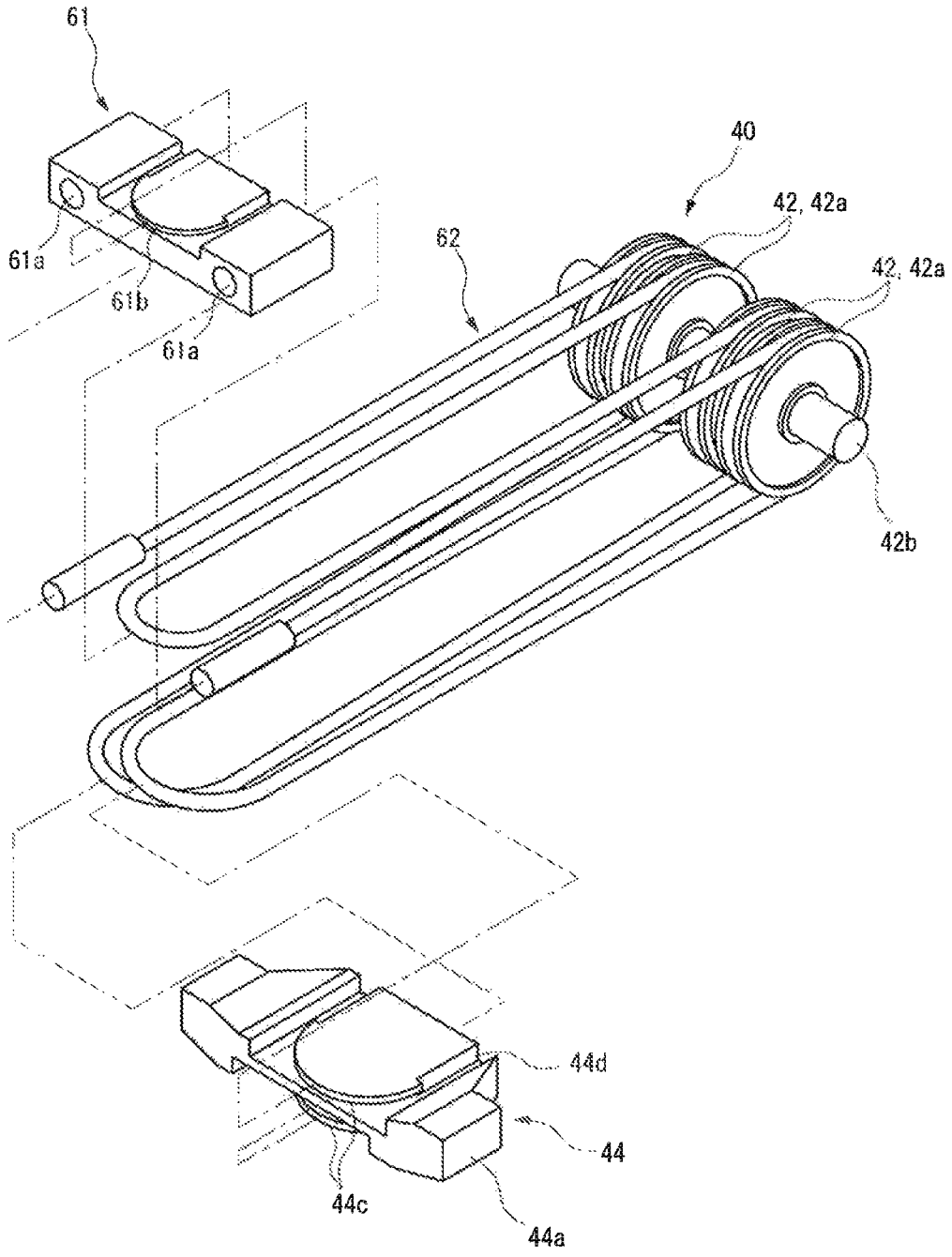
FIG. 7 is a perspective view illustrating another exemplary first coupling metal fitting.

In addition, fourth boom extending wire 41 is composed of two wire members 41*a* in the embodiment, the present invention is not limited to this. For example, first coupling metal fitting 61 illustrated in FIG. 7 includes two fixation holes 61*a* for fixing the end portions of a wire member, and wire locking part 61*b* for winding a middle portion of a wire member. With this configuration, fourth boom extending wire 62 can be composed of one wire member.

Reference Signs List

10 Extendable boom
12 Second boom
13 Third boom
14 Fourth boom
30 Second extendable cylinder
40 Fourth boom extending mechanism
41 Fourth boom extending wire
41*c* Stretched part
41*e* Locking part
42 Fourth boom extending sheave
42*a* Extending sheave
44 Second coupling metal fitting
44*a* Fixing piece
44*c* Wire locking part
44*e* Groove

The invention claimed is:

1. A boom-extending wire locking structure that locks an extending wire in an extendable boom, the extendable boom comprising:

a first boom member;

a second boom member that is extendable with respect to the first boom member;

a third boom member that is extendable with respect to the second boom member;

an extending wire that couples a base end side of the first boom member and a base end side of the third boom member; and an extending sheave provided at a leading end side of the second boom member with a part of the extending wire wound around the extending sheave, the extending sheave being configured to cause a movement of the third boom member with respect to the second boom member in an extending direction by moving a coupling part of the extending wire on the third boom member side in the extending direction along with a movement of the second boom member with respect to the first boom member in the extending direction, wherein:

the extending wire includes a plurality of wire members, each of the wire members including a plurality of pairs of stretched parts stretched between the base end side of the first boom member and the base end side of the third boom member, and a lock part that is interposed between adjacent pairs of the stretched parts and locked at at least one of the base end side of the first boom member and the base end side of the third boom, a wire locking tool that locks the extending wire by winding the lock part of each wire member is provided at at least one of the base end side of the first boom member and the base end side of the third boom member, the wire locking tool includes a pair of fixing pieces provided on both sides in an orthogonal direction orthogonal to the extending direction and fixed to at least one of the first boom member and the third boom member, and a plurality of wire locking parts provided between the pair of fixing pieces, the wire locking parts including grooves for winding the respective lock parts of the wire members, each of the grooves having an arc shape, and the plurality of wire locking parts are arranged in a central axis direction of the arc shape between the pair of fixing pieces, and central axes of the wire locking parts are arranged at different positions in the orthogonal direction from respective adjacent wire locking parts.

2. The boom-extending wire locking structure according to claim 1, wherein:

the extending sheave includes a plurality of sheaves respectively provided for the plurality of pairs of stretched parts, and the plurality of sheaves are disposed at positions opposite to respective end portions of the grooves in the extending direction.

* * * * *